US005100239A

United States Patent [19]

Ono et al.

[11] Patent Number: 5,100,239

[45] Date of Patent: Mar. 31, 1992

[54] METHOD OF MANUFACTURING CONCRETE

[75] Inventors: Sadamu Ono; Sadao Goto; Koji Minegishi; Kenichi Oshita; Daisuke Ishikura; Yoshiaki Negami; Kazuya Kamezaki; Katsuhiko Kimura; Takashi Kuwahara; Yasuo Kajioka, all of Tokyo, Japan

[73] Assignee: Shimizu Construction Co., Ltd., Tokyo, Japan

[21] Appl. No.: 636,552

[22] Filed: Jun. 29, 1990

Related U.S. Application Data

[63] Continuation of Ser. No. 465,596, Jan. 19, 1990, abandoned, which is a continuation of Ser. No. 133,633, Dec. 16, 1987, abandoned.

[30] Foreign Application Priority Data

| | | | |
|---|---|---|---|
| Dec. 19, 1986 | [JP] | Japan | 61-303414 |
| Dec. 19, 1986 | [JP] | Japan | 61-303415 |
| Jun. 23, 1987 | [JP] | Japan | 62-155805 |
| Jun. 23, 1987 | [JP] | Japan | 62-155806 |
| Jun. 27, 1987 | [JP] | Japan | 62-160596 |

[51] Int. Cl.[5] ..... B28C 5/46; B28C 5/48

[52] U.S. Cl. ..... 366/7; 366/4; 366/8; 366/13; 366/14; 366/18; 366/31; 366/35; 366/38; 366/64; 366/108; 366/148; 366/168; 62/68

[58] Field of Search ..... 366/2-4,6-10, 366/12, 13, 16, 20, 31, 32, 35, 38, 26, 45, 46, 50, 64, 108, 109, 144, 145, 148, 156, 167, 14, 18, 155, 168; 62/68-70

[56] References Cited

U.S. PATENT DOCUMENTS

| | | | |
|---|---|---|---|
| 1,836,754 | 12/1931 | Hepburn | 366/25 |
| 1,859,324 | 5/1932 | Arnold | 366/7 |
| 1,947,345 | 2/1934 | Liland | 366/7 |
| 1,960,692 | 5/1934 | Brown et al. | 366/156 |
| 2,264,610 | 12/1941 | Beardsley | 366/4 |
| 2,384,573 | 9/1945 | Smith | 366/4 |
| 2,491,194 | 12/1949 | McShea | 366/145 X |
| 2,593,327 | 4/1952 | McIlvaine | 366/13 |
| 2,595,631 | 5/1952 | Bertoch | 366/7 |
| 2,758,445 | 8/1956 | Saxe | 366/144 X |
| 3,108,448 | 10/1963 | Hightower | 366/7 |
| 3,302,934 | 2/1967 | Milligan | 366/13 |
| 3,306,589 | 2/1967 | Uden | 366/16 |
| 3,459,409 | 8/1969 | Goldberger | 366/64 |
| 3,480,260 | 11/1969 | Fejnert | 366/4 |
| 3,558,105 | 1/1971 | Muritz | 366/109 |
| 3,583,172 | 6/1971 | Koudeloka | 366/4 |
| 3,687,420 | 8/1972 | Schweinfurth et al. | 366/109 |
| 4,106,112 | 8/1978 | Jones | 366/7 |
| 4,306,814 | 12/1981 | Magni | 366/10 |
| 4,361,405 | 11/1982 | Wedek et al. | 366/7 |
| 4,452,535 | 6/1984 | Reid | 366/22 |
| 4,479,362 | 10/1984 | McWhorter et al. | 62/70 X |
| 4,551,024 | 11/1985 | Clopp | 366/64 |
| 4,586,824 | 5/1986 | Haws | 366/64 |

FOREIGN PATENT DOCUMENTS

| | | | |
|---|---|---|---|
| 536646 | 2/1957 | Canada | 366/50 |
| D 11805 | 8/1956 | Fed. Rep. of Germany | 366/109 |
| 2438969 | 2/1976 | Fed. Rep. of Germany . | |
| 3525780 | 1/1987 | Fed. Rep. of Germany | 366/10 |
| 1135254 | 4/1957 | France | 366/13 |
| 61-201681 | 6/1986 | Japan . | |
| 137904 | 5/1990 | Japan | 366/101 |
| 1136834 | 1/1985 | U.S.S.R. | 366/108 |
| 1193202 | 11/1985 | U.S.S.R. | 366/7 |

*Primary Examiner*—Harvey C. Hornsby
*Assistant Examiner*—C. Cooley
*Attorney, Agent, or Firm*—Oblon, Spivak, McClelland, Maier & Neustadt

[57] ABSTRACT

Method for manufacturing concrete by mixing concrete materials including a cement, aggregate, admixture and at least one of water and ice. The aggregate is moved prior the mixing and a low-temperature liquid is sprayed on the aggregate for cooling while the aggregate is being moved.

13 Claims, 7 Drawing Sheets

METHOD OF MANUFACTURING CONCRETE

This application is a continuation of application Ser. No. 07/465,596, filed on Jan. 19, 1990, now abandoned, which is a continuation of application Ser. No. 07/133,633, filed on Dec. 16, 1987, now abandoned.

BACKGROUND OF THE INVENTION

The present invention relates to a method of manufacturing concrete and an apparatus therefor, and particularly, but not exclusively, relates to a method of manufacturing mass concrete and an apparatus therefor.

When mass concrete members used for dams, bridges, reactor facilities, or the like, are constructed, cracking tends to occur in the mass concrete members due to temperature stresses caused by heat of hydration of the cement. Therefore, it is important to prevent such cracks to ensure uniform quality.

In order to prevent the cracks in mass concrete members, the following methods have been employed. For example, according to a so-called pre-cooling method, variations in the temperature of the concrete throughout the mass, which are caused by heat of hydration of cement, are reduced by decreasing the temperature of the concrete when mixing is completed. According to another conventional method, use is made of a concrete of higher strength, which also undergoes a temperature rise due to heat of hydration similar to that of ordinary concretes, but in which the higher strength of the concrete increases the resistance to cracks.

In the pre-cooling method, prior to the mixing the concrete components, each component is pre-cooled, using cool water, cool air, or ice, so as to lower the temperature of the concrete at the end of mixing. The cooled components are then mixed so that cracks caused by thermal stresses can be prevented.

Recently, particles of ice have been used in place of water for mixing concrete, so as to uniformly disperse the components of the concrete, thereby enhancing the strength of the concrete while lowering the temperature of the concrete at the end of mixing by latent heat of the ice in the same manner as in the pre-cooling method.

However, in the above conventional methods of preventing cracks in mass concrete, the following problems arise. In the pre-cooling method, cool water, cool air, or ice is used as a coolant for cooling each component of the concrete. When the temperature of the concrete, at the end of mixing, must be lowered to a great extent, components may not be sufficiently cooled to a predetermined temperature. In addition, a considerable period of time is required to cool the components.

In the method wherein ice is used in place of water, particles of ice may remain in the concrete after mixing and the mixing time may be prolonged, depending on the size and amount of ice, and hence the amount of ice which may be used is limited. Therefore, the temperature of the concrete may not be sufficiently lowered as in the case of using cool water or cool air.

SUMMARY OF THE INVENTION

Accordingly, it is an object of the present invention to provide a method of manufacturing concrete and, an apparatus for practicing the method, in which aggregates are sufficiently cooled within a short period of time as compared to the conventional methods and thus the concrete at the end of kneading is sufficiently cooled so that cracking of the concrete is considerably reduced.

In order to achieve the above and other objects, one aspect of the present invention is directed to a method of manufacturing concrete by mixing concrete materials including cement, aggregates, and at least one of water and ice, including the step of moving the aggregate before the mixing, and the step of spraying a low-temperature fluid on the aggregate while the aggregate is being moved.

Another aspect of the present invention is directed to an apparatus for preparing aggregates, including means for spraying a low-temperature fluid on the aggregate to cool the aggregates before the aggregate is mixed with cement and water and/or ice, and moving the aggregates during the cooling operation.

DETAILED DESCRIPTION OF THE PREFERRED EMBODIMENTS

Figure 1:
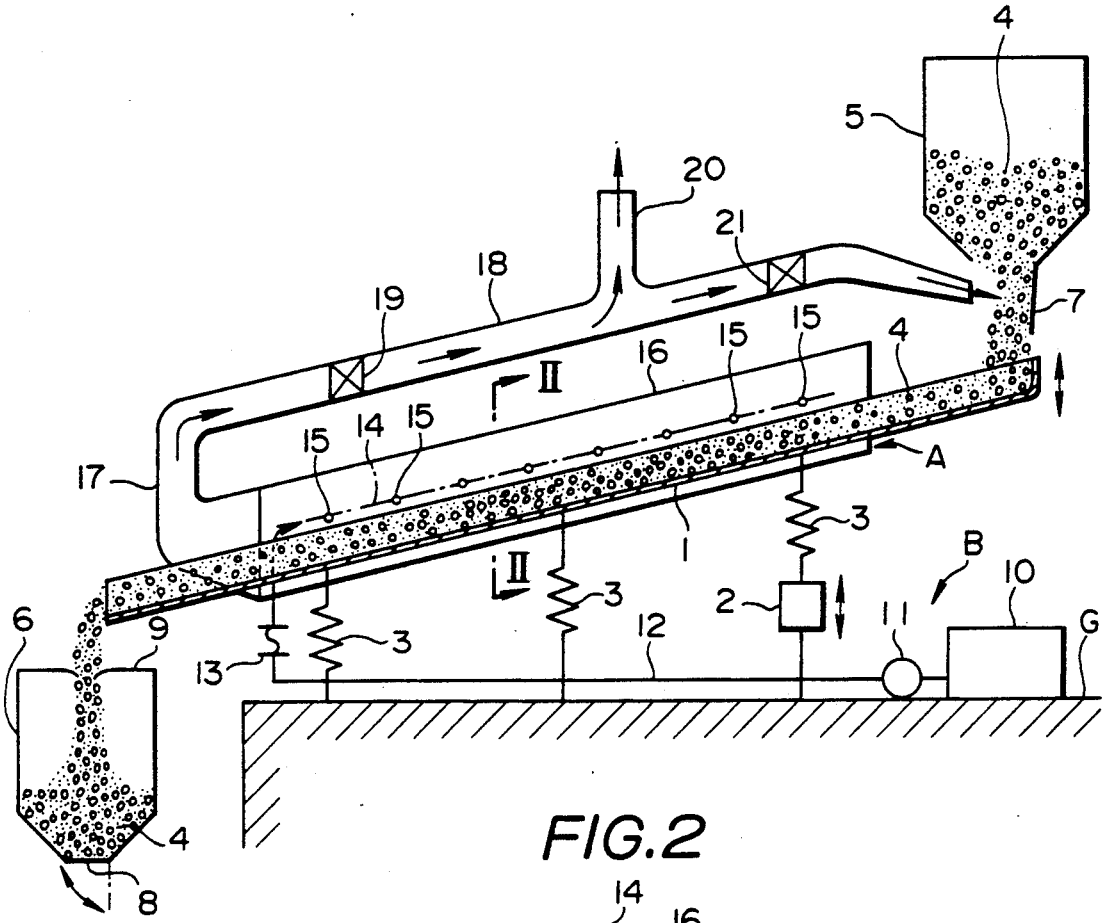
FIG. 1 is a schematic longitudinal sectional view of an aggregate cooling apparatus according to an embodiment of the present invention.

Preferred embodiments of the present invention will be described with reference to the accompanying drawings. The same reference numerals denote the same parts in the drawings, and hence description thereof will not be repeated after the first description.

Figure 2:
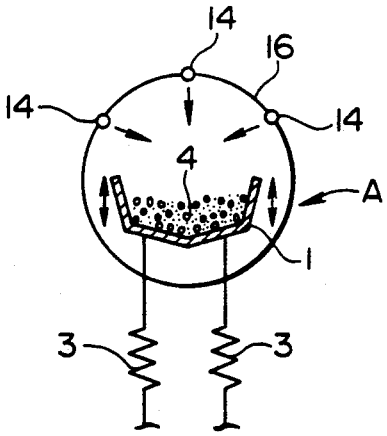
FIG. 2 is a cross-sectional view thereof taken along a line II—II of FIG. 1.

FIGS. 1 and 2 show an aggregate cooling apparatus according to the present invention. This apparatus produces frozen sand (fine aggregate), on the surfaces of grains of which ice layers are formed. Referring to FIGS. 1 and 2, reference character A denotes a vibrating chute system mounted on a base G. The vibrating chute system A is constituted by a substantially U-shaped chute 1 for transferring sand 4, a vibrating mechanism 2, and three pairs of coil springs 3. Two pairs of the coil springs 3 are arranged on the base G and support the chute 1 from the lower side. The chute 1 is tilted so that the start position of the chute is slightly higher than the end position thereof. In addition, the chute 1 is designed to be vertically vibrated by the vibrating mechanism 2 and the coil springs 3. Silos 5 and 6 are arranged above the start position of the chute 1 and below the end position thereof, respectively. Covers 7 and 8 which can be opened/closed are arranged on lower end opening portions of the silos 5 and 6. A cover 9 is arranged on an upper end portion of the silo 6 located at the end position of the chute 1 so as to enhance the cold insulation effect. The cover 9 is opened by the weight of the sand 4, and automatically closes when the sand 4 is not supplied. The cover 9 is preferably made of, for example, hard rubber. The silo 6 is preferably a silo whose heat insulation effect is enhanced by, for example, forming a known heat-insulating material on a wall surface, and the like, of the silo.

A cylindrical freezing duct 16, both ends of which are opened, covers the entire chute 1 except for the start and end positions thereof, i.e., portions for receiving and discharging the sand 4 from/to the silos 5 and 6. The freezing duct 16 communicates with a cool air duct 18 at the end position of the chute 1 through a communicating duct 17. Blowers 19 and 21 are arranged inside the cool air duct 18. The cool air duct 18 branches into two paths midway along the duct. One path serving as a branch pipe 20 is connected to a silo (not shown) storing coarse aggregate, while the other path is directed downward to the silo 5 located at the start portion of the chute 1. The end portion of the chute 1 extends through the start portion of the communicating duct 17 so as to transfer the sand 4 to the silo 6.

A cooler B is arranged near the chute 1 to cool the sand 4, transferred along an upper surface of the chute 1, by spraying liquid nitrogen on the sand 4. The cooler B is constituted by a liquid nitrogen tank 10 located on the base G or elsewhere, a controller 11 for controlling the amount of liquid nitrogen supplied from the tank 10, a supply pipe 12 for supplying the liquid nitrogen from the controller 11 to the chute 1, pipes 14 communicating with the supply pipe 12 through a flexible joint 13 and arranged above the chute 1 (located in the freezing duct 16) to extend in a longitudinal direction thereof, and spray nozzles 15 for spraying the liquid nitrogen on the sand transferred in the chute 1. The spray nozzles are formed in the pipes 14 at predetermined intervals in the longitudinal direction thereof.

An operation of the above-described aggregate cooling apparatus will be described below.

The vibrating mechanism 2 of the vibrating chute system A is driven to vertically vibrate the chute 1 in advance. A vibration frequency and stroke of the chute 1 can be arbitrarily set. Time for conveying the sand 4 along the chute 1 can be controlled by appropriately adjusting these parameters.

Subsequently, the sand 4 stored in the silo 5 is dropped on the start-position portion of the chute 1 by opening the cover 7. The sand is then transferred along the chute 1 while agitated vibrating through, jumping, and rolling, and is charged into the silo 6 from the end position portion of the chute 1.

The liquid nitrogen is sprayed on the sand 4 by the cooler B while the sand 4 is agitated via the vibrating, jumping and rotating while it is transferred along the chute 1. More specifically, the controller 11 controls and supply the liquid nitrogen from the tank 10 to the pipes 14 through the supply pipe 12. Subsequently, the liquid nitrogen is sprayed on the sand 4 through the spray nozzles 15, thereby cooling the sand 4 below 0° C. As a result of the agitation and spraying, water on the surfaces of the grains of sand 4 is frozen and ice layers are formed on the surfaces thereof. The sand 4 used for normal concrete manufacture includes 5 to 10% water. If the amount of surface water is regarded to be insufficient, the amount of surface water is preferably controlled by, for example, sprinkling the sand with water in advance. The discharge rate of the liquid nitrogen from the spray nozzles 15 can be set so that a desired cooling temperature can be obtained in accordance with the type of material to be cooled by controlling the time for conveying the sand 4 along the chute 1. This conveying time control is achieved by appropriately selecting the vibration frequency and the stroke of the chute 1.

When sand and gravel are cooled below 0° C., water at the surfaces thereof may form ice layers or may partly form fine ice grains, separate from the sand and the gravel, and exist in a mixed state with the sand and gravel.

At the same time, blowers 19 in the cool air duct 18 are driven to generate air flowing in a direction indicated by arrows in FIG. 1, i.e., from the freezing duct 16 to the cool air duct 18. As a result, low-temperature air which has cooled the sand 4 flows through the freezing duct 16, communicating duct 17, and the cool air duct 18 in that order, and part of the air is supplied to the silo storing the coarse aggregate through the branch pipe 20, thereby cooling the coarse aggregate, while the rest of the air is supplied to a lower portion of the silo 5 to pre-cool the sand 4.

According to the above-described method, the sand grains, on the surfaces of which ice layers are formed, can be produced. Thereafter, concrete is manufactured by mixing the sand 4 with gravel (coarse aggregate), cement, and water or particles of ice, and if necessary, mixing in various types of admixtures. Although a method of mixing these components of the concrete can be arbitrarily selected, it is preferable to select, for example, a method wherein the sand 4 having ice layers formed on the surfaces of the grains thereof is supplied into a mixing device such as a concrete mixer, and then cement, gravel, and water or ice are sequentially supplied into the mixing device in that order, and these components are mixed together, thereby manufacturing the concrete. These components may be simultaneously supplied into the mixing device.

It is also preferable to select a method wherein the sand 4 is mixed with cement such that grains of the cement are evenly distributed over the surfaces of the ice layers of the sand 4, and then the sand 4 thus processed, along with gravel, and water or particles of ice, are simultaneously supplied into the mixing device. In this case, the temperature of the concrete at the end of mixing can be lowered in the same manner as in the conventional method (to enhance the strength of the concrete) by replacing some of the water with particles of ice.

Therefore, according to the aggregate cooling apparatus described above, the sand 4 can be cooled to below 0° C. by spraying liquid nitrogen on the sand 4 while the sand 4 transferred along the surface of the chute 1 is agitated by vibrating the chute 1 using the vibrating mechanism 2. As a result, water on the surfaces of grains of the sand 4 can be frozen, and hence an ice layer can be formed on the surface of each grain. In addition, since the cooling of the sand 4 is performed using the liquid nitrogen having a very low temperature, it can be performed within a short period of time, and moreover, since cooling is performed while the sand 4 is vibrated, the ice layers can be easily and reliably formed. Furthermore, since the sand 4 is quickly cooled by the liquid nitrogen to a very low temperature, after the ice layers are formed, the grains of the sand 4 are separated and do not adhere to one another.

Accordingly, concrete can be manufactured by the above-described aggregate cooling apparatus using the sand 4, on each surface of the grains of which an ice layer is formed while the following effects concerning a decrease in temperature of the concrete at the end of mixing, an increase in strength of the concrete, and the like, can be obtained according to the same steps, as described below.

(1) Since the ice layers are formed on the grains of sand 4, the temperature of the concrete at the end of mixing can be lowered due to latent heat of the ice and heat sink effects of the sand 4. As a result, the same effect as in the conventional pre-cooling method can be obtained. For example, assume that the sand 4 includes 5% by weight of surface water and the total amount of the fine aggregate is 850 $kg/m^3$ (20° C.). The effect obtained by freezing the entirely of the surface water is equivalent to or superior to the effect obtained by using 42.5 $kg/m^3$ of ice in place of water used for the mixture, or the effect when 170 kg of water having a temperature of 20° C. is cooled to 0° C.

Figure 3:
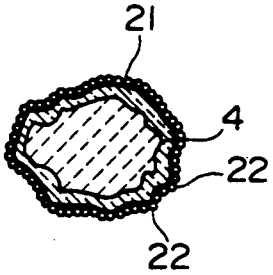
FIG. 3 is a schematic enlarged sectional view of a grain of sand cooled by the aggregate cooling apparatus in FIGS. 1 and 2.

(2) When various components of concrete are mixed together, a large number of cement grains 22 adhere to grains of the sand 4 through layers of ice 21, as shown in FIG. 3. Accordingly, in the mixture of the components of the concrete, since the grains of cement are evenly dispersed and the so-called bearing effect is obtained, the amount of water necessary for obtaining a desired physical value can be reduced. Therefore, if the unit amount of cement is not changed, the strength of the concrete can be increased. In addition, when the components are mixed, a dense cement paste can be formed on the surface of the grains of sand 4 because of the presence of the grains 22 of the cement. As a result, adhesion strength between the grains of the sand 4, or between other coarse aggregate such as gravel and sand 4 in the concrete, can be increased.

According to this method of manufacturing concrete, the temperature of the concrete at the end of mixing can be lowered, while the strength of the concrete can be increased without using ice in place of water in the mixture. Therefore, unlike the conventional method wherein a part of the water used for the mixture is replaced with particles of ice, even when the temperature of the concrete is not relatively high during seasons other than summer, ice does not remain in the resultant concrete. Thus, the same effect as described above can be obtained even under severe construction conditions during of the fall, winter, and the spring. Although in this embodiment surface water of aggregates is frozen, this is not essential.

Figure 4:
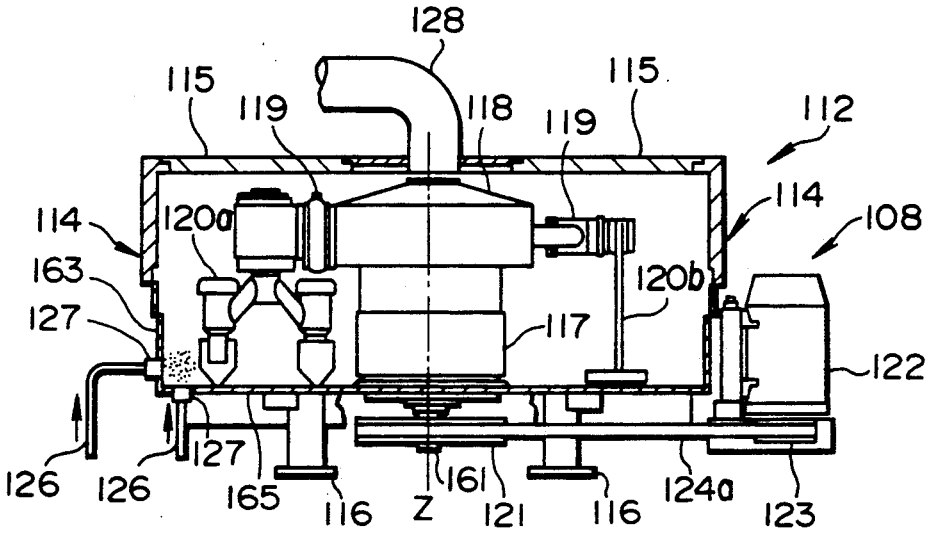
FIG. 4 is a cutaway side view of an aggregate cooling apparatus according to another embodiment of the present invention.
Figure 5:
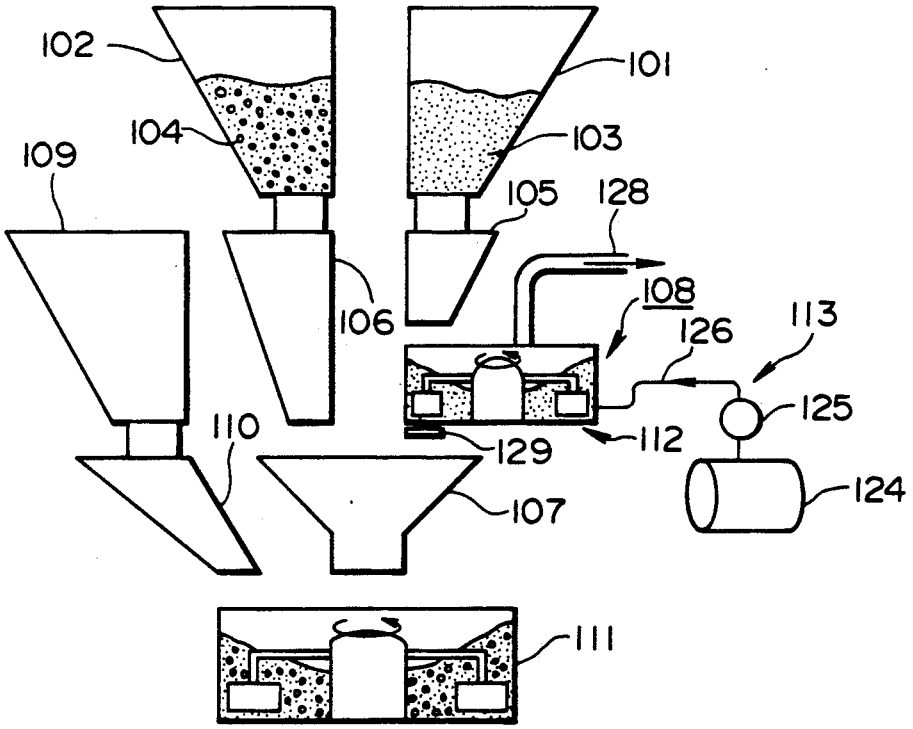
FIG. 5 is a schematic view illustrating a concrete manufacturing apparatus using the aggregate cooling apparatus in FIG. 4.

FIGS. 4 and 5 show another embodiment of the present invention. Referring to FIG. 5, reference numeral 101 denotes a sand stocker for storing sand (fine aggregate) 103; 102 is a gravel stocker for storing gravel (coarse aggregate) 104; 105 is a sand weighing device for weighing the sand 103 supplied from the sand stocker 101; and 106 is a gravel weighing device for weighing the gravel 104 supplied from the gravel stocker 102. An aggregate hopper 107 for temporarily storing the weighed sand 103 and gravel 104 is arranged under the sand and gravel weighing devices 105 and 106, and an aggregate cooling apparatus 108 according to this embodiment is interposed between the sand weighing device 105 and the aggregate hopper 107. Although a known heat-insulating material is preferably formed on, for example, a wall surface of the aggregate hopper 107 to enhance the heat-insulating effect, if the sand 103 or the gravel 104 need not be temporarily stored, the aggregate hopper 107 may be omitted.

Reference numeral 109 denotes a cement stocker for temporarily storing cement. A cement weighing device 110 is located under the cement stocker 109 and coupled thereto. Concrete mixer 111 for mixing components of concrete such as cement and aggregate is arranged under a supply port of the cement weighing device 110 and a supply port of the aggregate hopper 107. A heat-insulating material is preferably formed on, for example, a wall surface of the concrete mixer 111 in the same manner as in the aggregate hopper 107 to enhance the heat-insulating effect. Note that supply devices for supplying water, admixture, etc., used in the mixture into the concrete mixer 111 are omitted for the sake of simplicity.

The aggregate cooling apparatus 108 is constituted by an aggregate mixer 112 for mixing the sand 103; and a cooler 113, provided to the aggregate mixture 112, for cooling the sand 103 by spraying liquified gas on the sand 103 in the aggregate mixer 112.

The aggregate mixer 112 is constituted by a tub-like drum 114, a substantially disk-like cover 115 for covering an upper opening of the drum 114, and support legs 116 arranged at a bottom portion of the drum 114. The cover 115 has an aggregate charge port (not shown) through which aggregate is charged into the drum 114, while an aggregate discharge port (not shown) is formed in the bottom portion of the drum 114. A column-like support cylinder 117 is vertically fixed at the center of the drum 114, while a rotor 118 is mounted on an upper portion of the support cylinder 117 to be pivotally supported around a vertical axis Z. A plurality of arms 119 radially extend from a circumferential portion of the rotor 118, while scrapers 120*a* or 120*b* for mixing the sand 103, and the like, stored in the drum 114 extend from distal end portions of the arms downwardly. A rotary shaft 161 extends from the bottom portion of the drum 114 to penetrate the support cylinder 117 along the axis Z. An upper end of the rotary shaft 161 is fixed to the rotor 118, and a pulley 121 is fixed to a lower end of the rotary shaft 161. Reference numeral 122 denotes a motor for rotating the rotor 118. A drive shaft of the motor 122 is coupled to a pulley 123 arranged on a lower end of the motor 122. A V belt 124*a* is arranged around the pulleys 121 and 123 to transfer a rotating force of the motor 122 to the rotor 118. Note that in the aggregate mixer 112, a heat-insulating material is preferably formed on a wall surface of the drum 114 in the same manner as in the concrete mixer 111 so as to enhance the heat-insulating effect.

The cooler 113 is constituted by a liquid gas or cool air tank 124 arranged near the aggregate mixer 112 or elsewhere, a controller 125 for controlling the amount of liquid gas supplied from the tank 124, supply pipes 126 for supplying the liquid gas from the controller 125 toward the aggregate mixer 112, and a plurality of spray nozzles 127, provided at distal ends of the supply pipes 126 and arranged on a lower end portion of side plate 163 on the drum 114 side and a bottom plate 165, for spraying the liquid gas toward the bottom portion of the drum 114. As a result, the liquid gas is directly sprayed from the spray nozzles 127 on the aggregate (sand 103) stored in the bottom portion of the aggregate mixer 112.

Reference numeral 128 denotes an exhaust duct mounted on the cover 115 of the aggregate mixer 112, for discharging a gas derived from the liquid gas supplied into the aggregate mixer, or cool air supplied into the aggregate mixer 112 outside the system. Reference numeral 129 denotes a screen for adjusting the grade of the sand discharged from the aggregate discharge port (not shown). The low-temperature gas exhausted from the exhaust duct 128 is supplied to the sand and gravel stockers 101 and 102, or to the concrete mixer 111, as needed, and is used for pre-cooling the sand 103 and the gravel 104, or cooling during the mixing of the concrete.

A method of cooling the aggregate using the aggregate cooling apparatus 108 with the above-described arrangement will be described below.

The sand 103 is transferred in advance into the sand stocker 101 using a conveyor (not shown), or the like. When concrete is to be manufactured, the sand 103 is appropriately supplied from the sand stocker 101 to the sand weighing device 105 to weigh the sand 103 according to a predetermined mixing ratio for the concrete. The weighed sand 103 is charged into the drum 114 of the aggregate mixer 112.

After the sand is charged into the drum 114, the scrapers 120 arranged in the drum 114 are rotated inside the mixer 112 by driving the motor 122, thereby mixing the sand 114 inside the drum 114. The controller 125 controls to supply the liquid gas, or the like, from the tank 124 to the spray nozzles 127 through the supply pipes 126 so that the liquid gas or the like is sprayed inward from the spray nozzles 127 toward the bottom portion of the drum 114, thereby directly spraying the liquid gas or the like on the bottom of the sand 103. As a result, the sand 103 is instantly cooled below 0° C. so that water on the surfaces of grains of the sand 103 is frozen, and ice layers are formed on the grains. If the sand 103 is cooled to between −5° C. and −10° C., or below, the ice layers on the surfaces of the grains of the sand 103 are separated from one another, and hence a large number of the grains of the sand 103 are rarely fused into a frozen mass.

The sand 103 used for normal concrete manufacture contains 5 to 10% by weight of surface water. If, however, the amount of surface water is regarded to be insufficient, the amount of surface water is preferably adjusted in advance by sprinkling the sand 103 with water. With a surface water ratio of more than about 15% by weight, water is liable to separate from the aggregate, and this is not preferable. Concrete is efficiently cooled by using an aggregate having a surface water ratio of more than about 3% by weight. The discharge rate of the liquid gas from the spray nozzles 127 can be arbitrarily set. A desired cooling temperature can be obtained in accordance with the type of material to be cooled by appropriately adjusting and selecting the discharge rate, the rotating speed of the scrapers 120 of the aggregate mixer 112, and the time for retaining the liquid gas in the aggregate mixer 112.

After the sand 103 is discharged from the aggregate discharge port (not shown) while the sand 103 is kept mixed by the scrapers 120 and the grading of the sand 103 is adjusted by filtering the sand 103 through the screen 129, the sand 103 is charged into the aggregate hopper 107. As a result, ice layers can be formed on the surfaces of the grains of the sand 103 prior to mixing. When the cooling operation of the sand 103 in the aggregate mixture 112 is not performed, the spray nozzles 127 continue to spray nitrogen gas, air, or the like, to prevent the distal ends of the nozzles 127 from clogging or freezing.

Subsequently, concrete is manufactured as follows. Gravel is appropriately supplied from the gravel stocker 102 to the gravel weighing device 106 and is weighed thereby, and then charged into the aggregate hopper 107. The low-temperature sand 103, the gravel 104, the cement, and the water or the particles of ice are mixed together, and various admixtures are mixed as needed, thereby manufacturing the concrete. Although a method of mixing these components of the concrete can be arbitrarily selected, it is preferable to select, for example, a method wherein the low-temperature sand 103 and the gravel 104 are charged from the aggregate hopper 107 into the concrete mixer 111, and then the cement, the gravel, and the water or the particles of ice are sequentially supplied into the concrete mixer 111 in the order named, and these components are mixed together, thereby manufacturing the concrete. These components may be simultaneously supplied into the concrete mixer 111.

According to the aggregate cooling apparatus 108 described above, the surface water of the sand 103 can be frozen by cooling the sand 103 below 0° C., and hence ice layers can be formed on the surfaces of the grains the sand 103 prior to mixing of the components of the concrete such as cement and aggregate. In addition, since the sand 103 is cooled by spraying liquified gas, or the like, thereon while the sand 103 is mixed by the aggregate mixer 112, the liquified gas. or the like, can be uniformly sprayed to the grains of the sand 103. Therefore, since cooling efficiency of the sand 103 after treatment with liquified gas, or the like, is improved compared with that using the cooler shown in FIG. 1, the cost required for cooling the sand 103 can be reduced.

Figure 6:
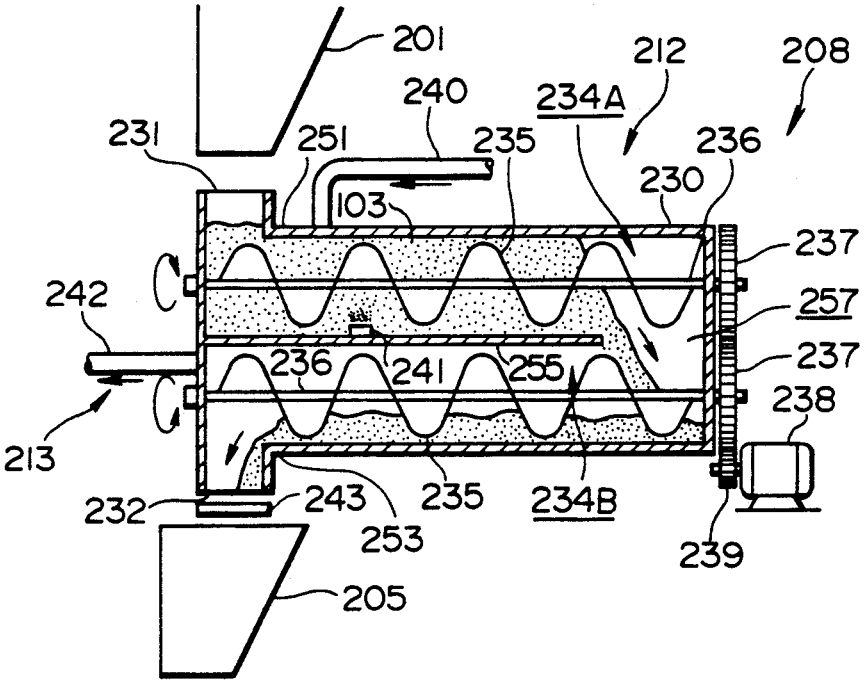
FIG. 6 is a vertical sectional view of an aggregate cooling apparatus according to still another embodiment of the present invention.

FIG. 6 shows an aggregate cooling apparatus 208 according to still another embodiment of the present invention. Similar to the aggregate cooling apparatus 108 in the above embodiment, the aggregate cooling apparatus 208 is constituted by an aggregate mixer 212 and a cooler 213 provided to the aggregate mixer 212.

A housing 230 of the aggregate mixer 212 includes substantially cylindrical upper and lower chambers 234A and 234B. An aggregate charge port 231 is formed at one end of an upper wall 251 of the upper chamber 234A and an aggregate discharge port 232 is formed at one end of a lower wall 253. An opening 257 is formed at the other end of a wall 255 of the chambers 234A and 234B so that the chamber 234A communicates with the chamber 234B. Screw conveyors 235 are arranged inside the chambers 234A and 234B. Rotary shafts 236 of the screw conveyors 235 extend in a longitudinal direction of the chambers 234A and 234B and are concentrical therewith, respectively, while both ends of the rotary shafts 236 are pivoted to the housing 230. As a result, the screw conveyors 235 are pivotally supported by the housing 230. One end (right end in FIG. 6) of each of the rotary shafts 236 extends outwardly from the housing 230, while gears 237 are coaxially mounted on the extending portions of the rotary shafts 236, respectively. These gears are meshed with each other, while a gear 239 coupled to a drive shaft of a motor 238 is meshed with the lower gear 237. More specifically, the rotating force of the motor 238 is transmitted to the screw conveyors 235 through the gears 237 and 239, while the screw conveyors 235 are rotated in the opposite directions. Similar to the embodiment shown in FIG. 4, a heat-insulating material is preferably formed on, e.g., a wall surface of the aggregate mixer 212 in this embodiment to enhance the heat-insulating effect.

Similar to the cooler 113 in the embodiment of FIG. 4, the cooler 213 is constituted by a liquified gas or cool air tank (not shown), a controller (not shown) for controlling a supply amount of liquified gas or the like supplied from the tank, a supply pipe 240 for supplying the liquified gas or the like from the controller to the aggregate mixer 212, and a spray nozzle, provided at a distal end of the supply pipe 240 and arranged on a bottom portion of the chamber 234A of the aggregate mixer 212, for spraying the liquified gas, or the like, inwardly from the bottom portion of the chamber 234A. Reference numeral 242 denotes an exhaust duct arranged on the housing 230 to communicate with the lower chamber 234B; and 243, a screen.

A method of cooling the sand on surfaces of grains of which ice layers are formed using the aggregate cooling apparatus 8 with the above-described arrangement is substantially the same as that using the aggregate cooling apparatus described in the embodiment of FIG. 4. The sand 103 is supplied from the sand stocker 201 to the aggregate cooling apparatus 208. Ice layers are formed on the surfaces of the grains of the sand 103 by cooling the sand 103 using the aggregate cooling apparatus 208. More specifically, after the sand 103 is charged into the housing 230 through the aggregate charge port 231, the screw conveyors 235 inside the housing 230 are rotated by driving the motor 238 so that the sand 103 is conveyed from the aggregate charge port 231 to the aggregate discharge port 232, while the sand 103 is mixed by the screw conveyors 235. Thereafter, the controller controls to supply the liquid gas or the like from the tank to the spray nozzle 241 through the supply pipe 240 so that the liquid nitrogen is sprayed by the spray nozzle 240 inwardly from the bottom portion of the chamber 234A, thereby directly spraying the liquid gas or the like on the bottom of the sand 103. As a result, the sand 103 is instantly cooled below 0° C. so that water on the surfaces of the grains of the sand 103 is frozen and ice layers are formed thereon.

Figure 7:
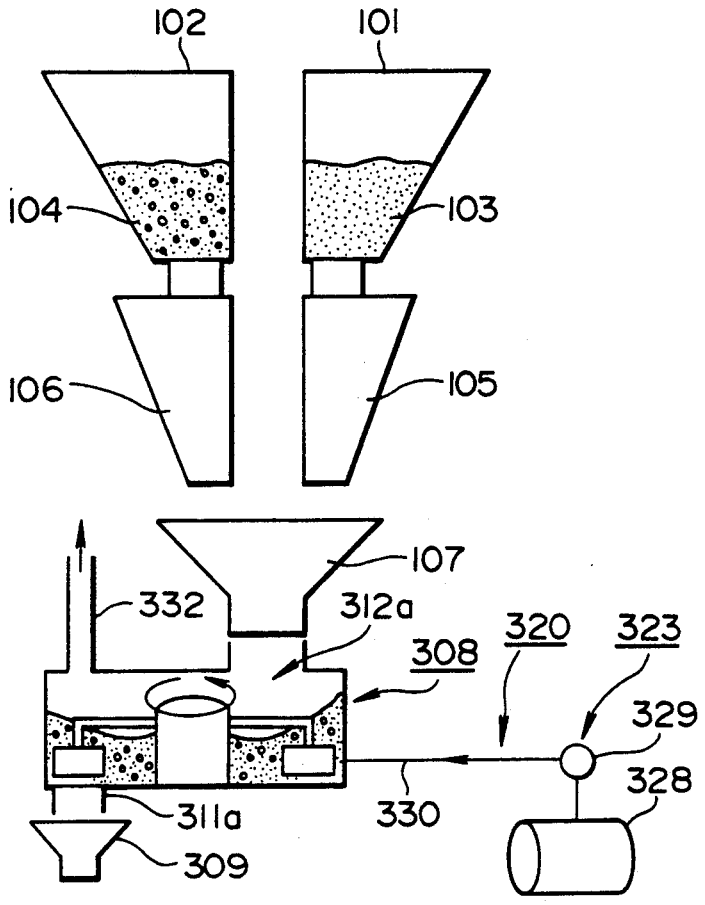
FIG. 7 is a schematic view of a concrete manufacturing apparatus using a concrete mixer according to still another embodiment of the present invention.
Figure 8:
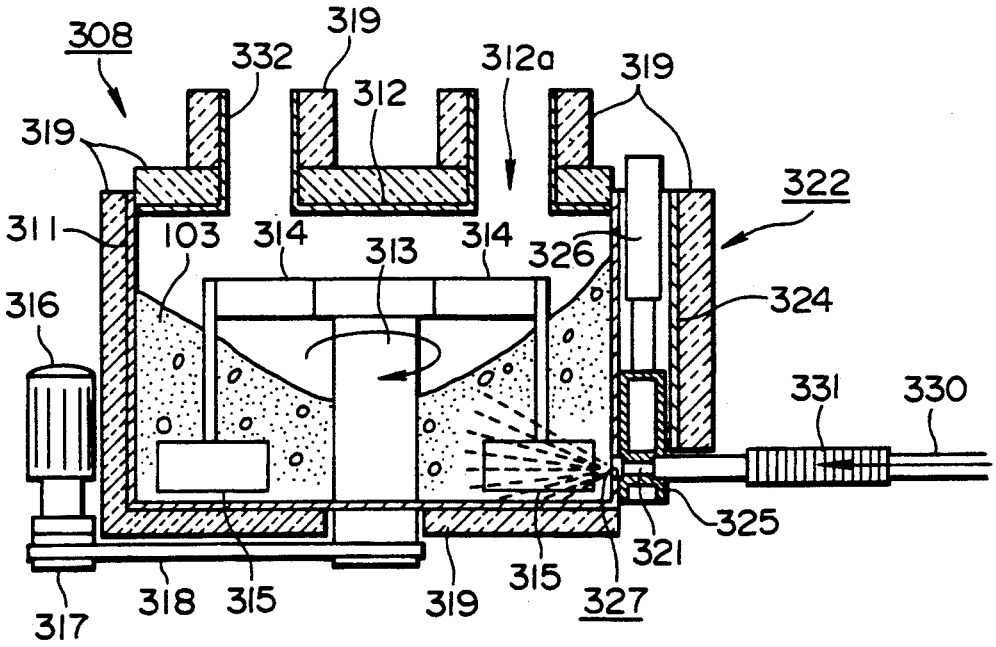
FIG. 8 is an enlarged sectional view of the concrete mixer of FIG. 7 along the axial direction.
Figure 9:
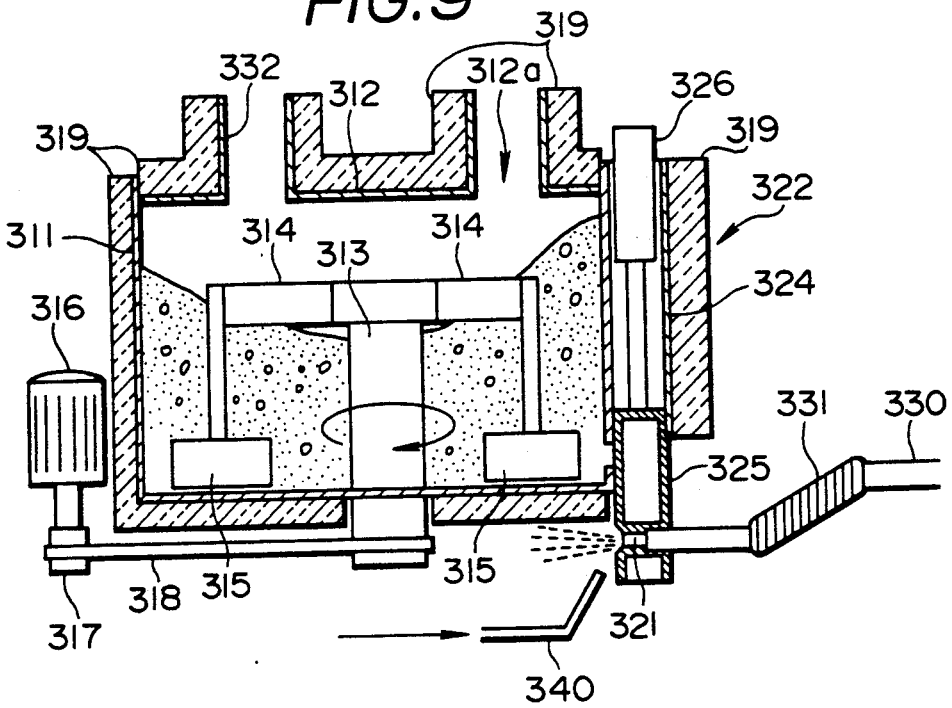
FIG. 9 is a sectional view showing another operation of the concrete mixer of FIG. 8 along the axial direction.

FIGS. 7 to 9 show a concrete manufacturing apparatus according to still another embodiment of the present invention. This concrete manufacturing apparatus is different from that in FIG. 5 in that sand 103 supplied from a sand weighing device 105 is directly supplied to an aggregate hopper 107, and a concrete mixer 308 having an aggregate cooling apparatus, is provided. In order to simplify the explanation, thereof feeders for supplying cement and water used for mixing to the concrete mixer 308 are omitted. A heat-insulating material is preferably formed on, for example, a wall surface of an aggregate hopper 107, to enhance the heat-insulating effect.

The concrete mixer 308 is constituted by a tub-like drum 311, a substantially disk-like cover 312 for covering an upper opening of the drum 311. The cover 312 has a material charge port 312*a* through which each component of concrete is charged into the drum 311, while an aggregate discharge port 311*a* is formed in a bottom portion of the drum 311. A cylindrical rotor 313 rotatably and vertically extends through the drum 311 and is coaxial therewith. A plurality of arms 314 radially extend from an upper portion of the rotor 118, while scrapers 315 for mixing the sand 103 stored in the drum 311 extend from distal end portions of the arms downward. Reference numeral 316 denotes a motor for rotating the rotor 313. A drive shaft of the motor 316 is coupled to a pulley 317 arranged on a lower end of the motor 316. A V belt 318 is wound around the pulleys 317 and a lower circumferential surface of the rotor 313 to transfer a rotating force of the motor 316 to the rotor 313. Note that heat-insulating materials 319 are adhered to outer surfaces of the drum 311 of the concrete mixer 308 and cover 312 so as to enhance the heat-insulating effect of the mixer 308.

The concrete mixer 308 is provided with an aggregate cooling apparatus 320 for cooling aggregate stored in the mixer 308 by spraying liquified gas such as nitrogen gas. The aggregate cooling apparatus 320 is arranged on a lower side wall portion of the drum 311 of the concrete mixer 308. The aggregate cooling apparatus 320 includes nozzles 321 (only one nozzle is shown in FIG. 8) for spraying the liquid gas or the like inward from a bottom portion of the mixer 308, a moving mechanism for mounting the nozzles 321 on the concrete mixer 308 such that the nozzles 321 can extend or can be retracted with respect to the concrete mixer 308, and a cooler 323 for supplying the liquified gas or the like to the nozzles 321.

The moving mechanism 322 is constituted by a box-like cylinder 324 arranged near the nozzles 321 and extending along a vertical direction of a wall of the drum 311, a piston 325 fitted to an inner surface of the cylinder 324 and having the nozzle 321 mounted on one end thereof, and a hydraulic jack 326 for sliding the piston 325 inside the cylinder 324 A nozzle hole 327 for spraying the liquified gas or the like is formed in a side wall of the drum 311 at a position opposite the nozzle 321 when the hydraulic jack 326 contracts. According to the above arrangement, the nozzle 321 communicates with the nozzle hole formed in the drum 311 of the concrete mixer 308 upon operation of the hydraulic jack 326. Similar to the drum 311, the heating material 319 is adhered to an outer surface of the cylinder 324.

The cooler 323 is constituted by a liquified gas or cool air tank 328 disposed near the concrete mixer 308 or elsewhere, a known controller 329 for controlling supplied amount of liquified gas, or the like, supplied from the tank 328, and a supply pipe 330 for supplying the liquified gas or the like from the controller 329 to the nozzle 321. A high-pressure flexible pipe 331 is mounted midway along the supply pipe 330 near a pipe portion to which the nozzle 321 is mounted.

Reference numeral 332 denotes an exhaust duct, formed on the cover 312 of the concrete mixer 308, for exhausting a gas derived from the liquified gas supplied into the concrete mixer 308 or cool air supplied into the concrete mixer 308 outside the system. The low-temperature gas or cool air exhausted from the exhaust duct 332 flows into the sand and gravel stockers 101 and 102 to pre-cool the sand 103 and the gravel 104

A method of manufacturing concrete using the concrete manufacturing apparatus with the above-described arrangement will be described below.

The sand and gravel 103 and 104 are transferred into the sand and gravel stockers 101 and 102 using conveyors (not shown) in advance. When concrete is to be manufactured, the sand and gravel 103 and 104 are supplied from the sand and gravel stockers 101 and 102 into the sand and gravel weighing devices 105 and 106 so as to weigh the sand and gravel 103 and 104 according to a predetermined mixing ratio for the concrete. The weighed sand and gravel 103 and 104 are charged into the aggregate hopper 107, and then charged into the concrete mixer 308 from the material charge port 312*a*.

When the sand and gravel 103 and 104 are charged, since the hydraulic jack contracts, the nozzle 321 is ready for spraying the liquified gas or the like into the drum 311 as shown in FIG. 8. In this state, the scrapers 315 inside the drum 311 are rotated in the mixer 308 by driving the motor 316, thereby mixing the sand and gravel 103 and 104 inside the drum 311. Subsequently, while the sand and gravel 103 and 104 are mixed, the controller 329 controls to supply the liquified gas or the like from the tank 328 to the nozzles 321 through the supply pipe 330 so that the liquified gas or the like is sprayed inward from the bottom portion of the drum 311 through the nozzle hole 327, thereby directly spraying the liquified gas or the like on the sand and gravel 103 and 104 from the bottom of the drum 311. As a result, the sand and gravel 103 and 104 are instantly and evenly cooled.

The discharge rate of the liquid gas from the spray nozzles 321 can be arbitrarily set. A desired cooling temperature can be obtained in accordance with the type of material to be cooled by appropriately adjusting and selecting the discharge rate, the rotating speed of the scrapers 315 of the concrete mixer 308, and the time for cooling the sand and gravel inside the mixer 308.

Thereafter, the nozzles 321 are moved to a lower position of the drum 311, as shown in FIG. 9, by extending the hydraulic jack 326, and then cement and water or particles of ice are charged into the concrete mixer 308. In addition, various admixtures are mixed in as needed, thereby manufacturing concrete. Although a method of mixing these components of the concrete can be arbitrarily selected, it is preferable to charge the cement and water or particles of the ice into the concrete mixer 308 in that order, and these components are mixed together, thereby manufacturing the concrete. These components may be simultaneously supplied into the concrete mixer 308.

When the liquid gas is used for cooling the sand and gravel 103 and 104, the spray nozzles 321, which are located at a position where the liquid gas is not sprayed into the drum during mixing of the components as shown in FIG. 9, continue to spray the liquified gas or air to prevent the distal ends of the nozzles 321 from clogging and freezing. Similarly, as shown in FIG. 9, a spraying pipe 340 having an opening may be arranged near the distal ends of the nozzles 321 so that room-temperature air or hot air can be sprayed on the distal ends of the nozzles 321 through the spraying pipe 340, thereby preventing clogging and freezing.

Figure 10:
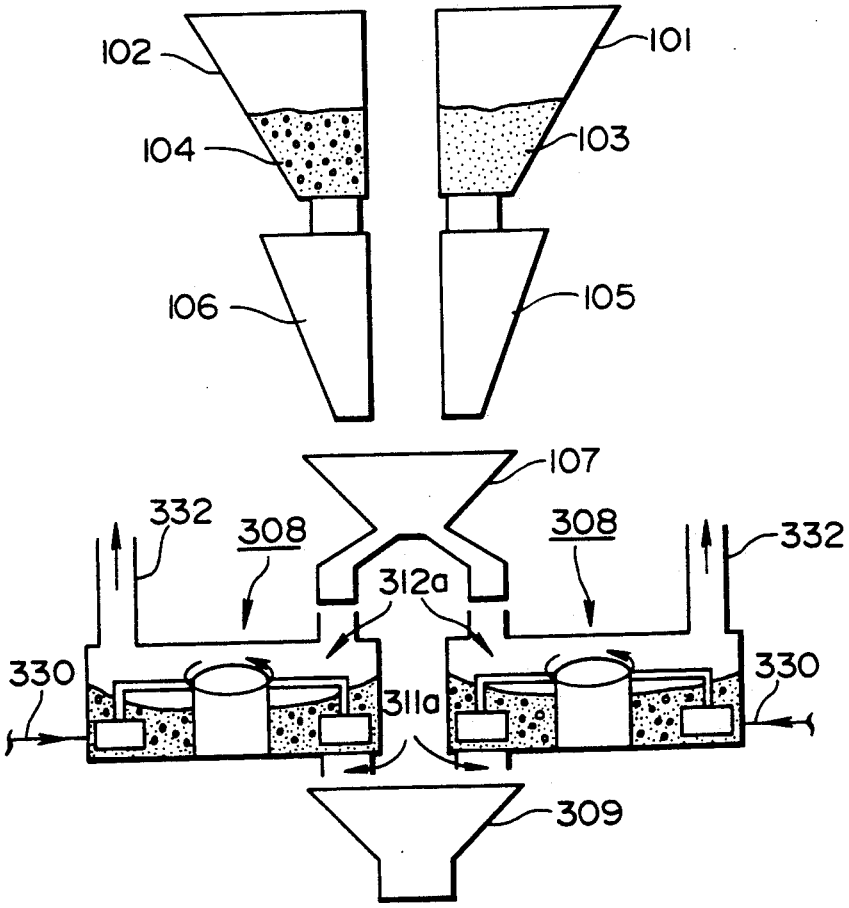
FIG. 10 is a schematic reduced sectional view showing a concrete manufacturing apparatus using a pair of concrete mixers in FIG. 8 according to a modification of the present invention.

FIG. 10 shows a modification of the concrete manufacturing apparatus in FIG. 7. In this modification, the aggregate supply port of the aggregate hopper 107 is branched into two ports, while the concrete mixers 308 are disposed under the ports, respectively. That is, the concrete manufacturing apparatus in this modification includes two concrete mixers 308. The aggregate is supplied from the aggregate hopper 107 to one or both of the mixers 308.

The method of manufacturing concrete using the concrete manufacturing apparatus shown in FIG. 10 is the same as that using the apparatus shown in FIG. 9. However, since the concrete manufacturing apparatus in this modification includes a plurality (two) of mixers 308, concrete can be alternately or simultaneously manufactured using the concrete mixers 308, thereby improving productivity of concrete. More specifically, according to the method of manufacturing concrete, the step of cooling the aggregate is added to the steps of manufacturing concrete. Therefore, if the concrete is manufactured by facilities having a size similar to that of a normal concrete plant, the cycle time of concrete manufacture is inevitably prolonged by the step of cooling the aggregate. However, by arranging a plurality of concrete mixers 308, high productivity of concrete which is equal to that of the normal concrete, plant, can be assured.

The method of manufacturing concrete and an apparatus therefor according to the present invention are not limited to the above-described embodiments. Various changes and modifications can be made within the spirit and scope of the present invention. For example, the low-temperature liquid and air for cooling the aggregate (sand and gravel) are not limited to liquid nitrogen or the like, as described in the embodiments. If liquid helium having a low boiling point is used, the aggregate can be more efficiently cooled. Furthermore, in the embodiments, the sand and the gravel need not be simultaneously cooled, only the sand or the gravel may be cooled, depending on a degree of drop in temperature of the concrete at the end of mixing.

The forms and shapes of the vibrating chute system A, the aggregate mixers 112 and 212, and the concrete mixer 308 are not limited to those described in the embodiments. Known devices can be used in place of them.

EXAMPLE 1

Figure 11:
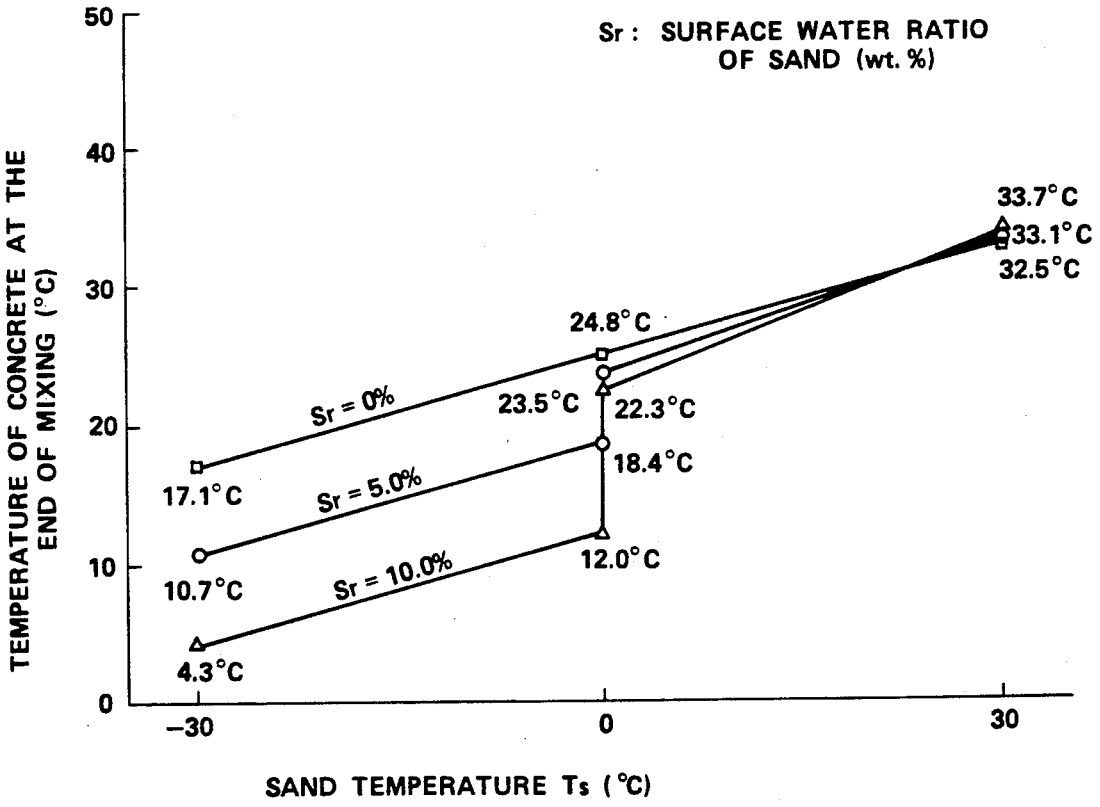
FIG. 11 is the graph showing a relationship between a temperature of sand and the temperature of concrete at the end of concrete mixing in an experiment.

Concrete was mixed according to the mixing amounts shown in Table 1 using the apparatus in FIG. 5. The temperatures of the components were: gravel temperature $T_g=30°$ C., water temperature $T_w=20°$ C., cement temperature $T_c=60°$ C., and sand temperatures $=-30°$ C., 0° C., and 30° C. The above sand, which had temperatures of $-30°$ C. and 0° C., were cooled by the apparatus shown in FIG. 4 using the liquid nitrogen. FIG. 11 shows a relationship between the sand temperatures and the temperatures of the concrete at the end of mixing when a surface water ratio $S_r$ of the sand was 0.0%, 5.0%, and 10.0 by weight %. It was confirmed in the experiment that the temperature of the concrete of 1 $m^3$ at the end of mixing was lowered by about 1° C. using 10 l of liquid nitrogen.

TABLE 1

| Water | Cement | Sand | kg/m³ Gravel |
|---|---|---|---|
| 150 | 300 | 738 | 1119 |

EXAMPLE 2

Figure 12:
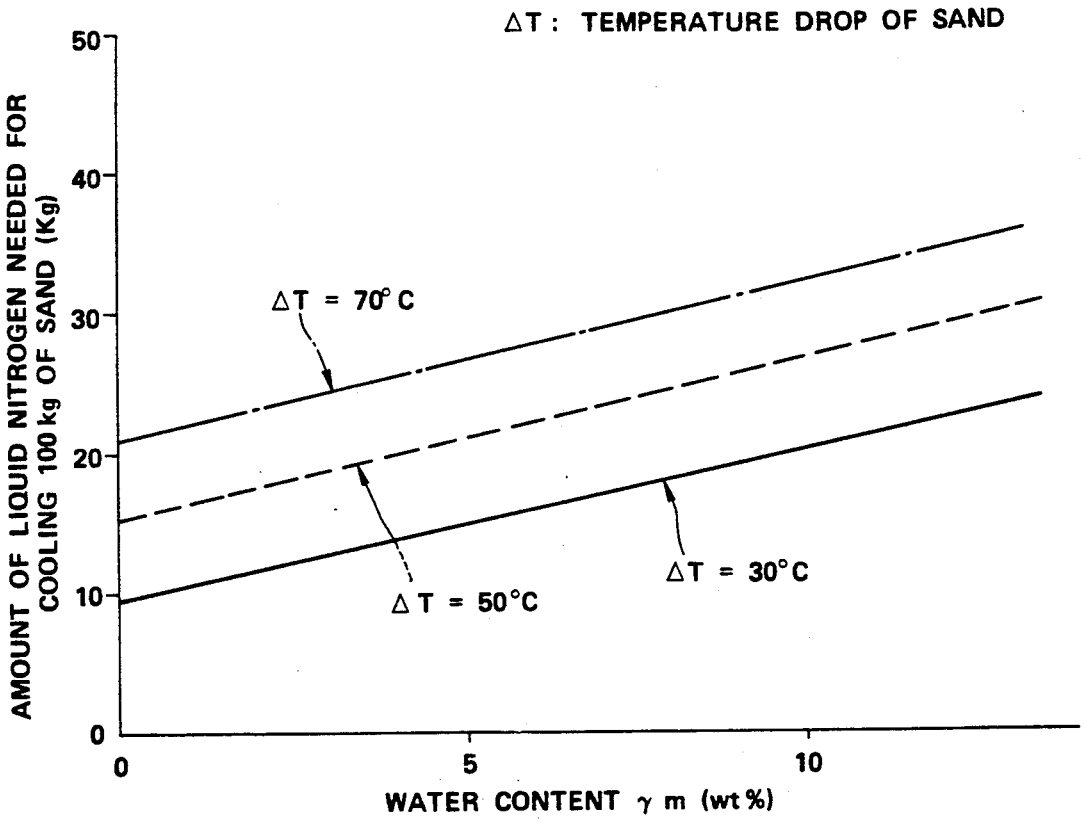
FIG. 12 is a graph showing a relationship between the water content of the sand and the amount of liquid nitrogen used for cooling the sand in an experiment.

Sand having a temperature of 30° C. was cooled by the aggregate cooling apparatus in FIG. 4 using liquid nitrogen. FIG. 12 shows the relationship between the water content $r_m$ and the amount of liquid nitrogen used in the experiment wherein a temperature drop $\Delta T$ of the sand of 100 kg=30° C., 50° C., and 70° C. It was confirmed in the experiment that the sand could be efficiently cooled using a relatively small amount of liquid nitrogen.

What is claimed is:

1. A method of manufacturing concrete from concrete materials including a cement, aggregate including at least one of coarse aggregate and fine aggregate containing water, admixture and at least one of water and ice, comprising the steps of:

agitating said aggregate prior to mixing said concrete materials so as to separate grains of said aggregate;

spraying a low temperature liquid from the group consisting of liquid nitrogen and liquid helium on said aggregate while said aggregate is being agitated to cool said aggregate and to form ice layers on surfaces of separated aggregate grains from said water contained in said aggregate; and mixing the separated aggregate grains having ice layers formed thereon with said cement, admixture and at least one of water and ice after said agitating and spraying steps so that cement adheres to the ice layers formed on said separated aggregate grains.

2. A method as recited in claim 1, wherein the agitating step includes the step of rotating the aggregate around at least one axis.

3. A method as recited in claim 1, further comprising the step of adjusting the aggregate in surface water ratio prior to the agitating step to provide a predetermined amount of surface water to the aggregate both for effectively preventing surface water from separating from the aggregate and for efficiently cooling the aggregate.

4. A method as recited in claim 3, wherein in the adjusting step, the aggregate is adjusted to contain less than about 15% by weight of surface water and more than about 3% by weight of surface water before the aggregate is entered into the spraying step.

5. A method as recited in claim 1, wherein the agitating step includes the step of vibrating the aggregate to cause it to jump and roll.

6. A method as recited in claim 1, wherein the aggregate contains less than about 5% by weight of surface water and more than about 3% by weight of surface water when the aggregate is supplied to the spraying step.

7. A method as recited in claim 6, wherein the agitating step includes the step of vibrating the aggregate to cause it to jump and roll.

8. A method as recited in claim 6, wherein the agitating step includes the step of rotating the aggregate around at least one axis.

9. A method as recited in claim 6, further comprising the step of adjusting the aggregate in surface water ratio prior to the agitating step to provide a predetermined amount of surface water to the aggregate.

10. A method as recited in claim 1, wherein the aggregate is a sand, and wherein in the spraying step, the sand is cooled to a temperature of −5° C. or below so that grains of the sand with the ice layers formed thereon may be separated from each other.

11. A method as recited in claim 1, wherein the aggregate comprises sand containing less than 5% by weight of surface water and more than about 3% by weight of surface water, and wherein in the spraying step, the sand is cooled to a temperature of −5° C. or below.

12. A method according to claim 11, wherein said low temperature liquid is sprayed directly into said aggregate to pass therethrough in an upward direction.

13. A method according to claim 1, wherein said low temperature liquid is sprayed directly into said aggregate to pass therethrough in an upward direction.

* * * * *